US006833661B1

(12) United States Patent
Tuyls et al.

(10) Patent No.: US 6,833,661 B1
(45) Date of Patent: Dec. 21, 2004

(54) DEFLECTION UNIT FOR A CATHODE RAY TUBE

(75) Inventors: Pim Theo Tuyls, Eindhoven (NL); Michel Cornelis Josephus Marie Vissenberg, Eindhoven (NL); Johannes Maria Maassen, Eindhoven (NL); Nicolaas Gerrit Vink, Eindhoven (NL); Albertus Aemilius Seyno Sluyterman, Eindhoven (NL); Wilhelmus Henrica Cornelis Theuws, Eindhoven (NL); Tjerk Gerrit Spanjer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/019,460

(22) PCT Filed: Apr. 13, 2000

(86) PCT No.: PCT/EP01/04320

§ 371 (c)(1),
(2), (4) Date: Dec. 26, 2001

(87) PCT Pub. No.: WO01/84589

PCT Pub. Date: Nov. 8, 2001

(51) Int. Cl.[7] ..... H01J 29/70
(52) U.S. Cl. ..... 313/440; 335/210
(58) Field of Search ..... 313/440, 442, 313/413; 335/210, 213, 214

(56) References Cited

U.S. PATENT DOCUMENTS

| | | | | | |
|---|---|---|---|---|---|
| 4,431,940 | A | * | 2/1984 | Habraken et al. | 313/413 |
| 4,749,975 | A | * | 6/1988 | Tokita et al. | 335/217 |
| 5,138,290 | A | * | 8/1992 | Togane et al. | 335/210 |
| 5,229,738 | A | * | 7/1993 | Knapen | 335/303 |
| 5,243,127 | A | * | 9/1993 | Kitagawa | 174/35 R |
| 5,515,220 | A | * | 5/1996 | Alioth | 360/281 |
| 5,637,955 | A | * | 6/1997 | Ji | 313/440 |
| 6,100,779 | A | * | 8/2000 | Luard et al. | 335/210 |
| 6,373,181 | B1 | * | 4/2002 | Vink et al. | 313/440 |
| 6,411,027 | B1 | * | 6/2002 | Sluyterman et al. | 313/440 |
| 6,455,997 | B1 | * | 9/2002 | Lee | 313/440 |

FOREIGN PATENT DOCUMENTS

| | | | | |
|---|---|---|---|---|
| JP | 58186004 A | * | 10/1983 | G01B/7/30 |
| WO | WO9826574 | | 6/1998 | |

* cited by examiner

*Primary Examiner*—Nimeshkumar D. Patel
*Assistant Examiner*—Karabi Guharay

(57) ABSTRACT

The invention relates to a deflection unit for cathode ray tubes in which the energy for deflection is reduced. This is done by providing a magnetic material between frame coils and line coils of the deflection unit. In an advantageous embodiment of the invention, first void spaces as well as second void spaces between the frame coils and a yoke ring and/or third void spaces between wire strands of the frame coils are filled. A deflection energy reduction of up to 30% can be obtained.

20 Claims, 7 Drawing Sheets

DEFLECTION UNIT FOR A CATHODE RAY TUBE

Figure 1:
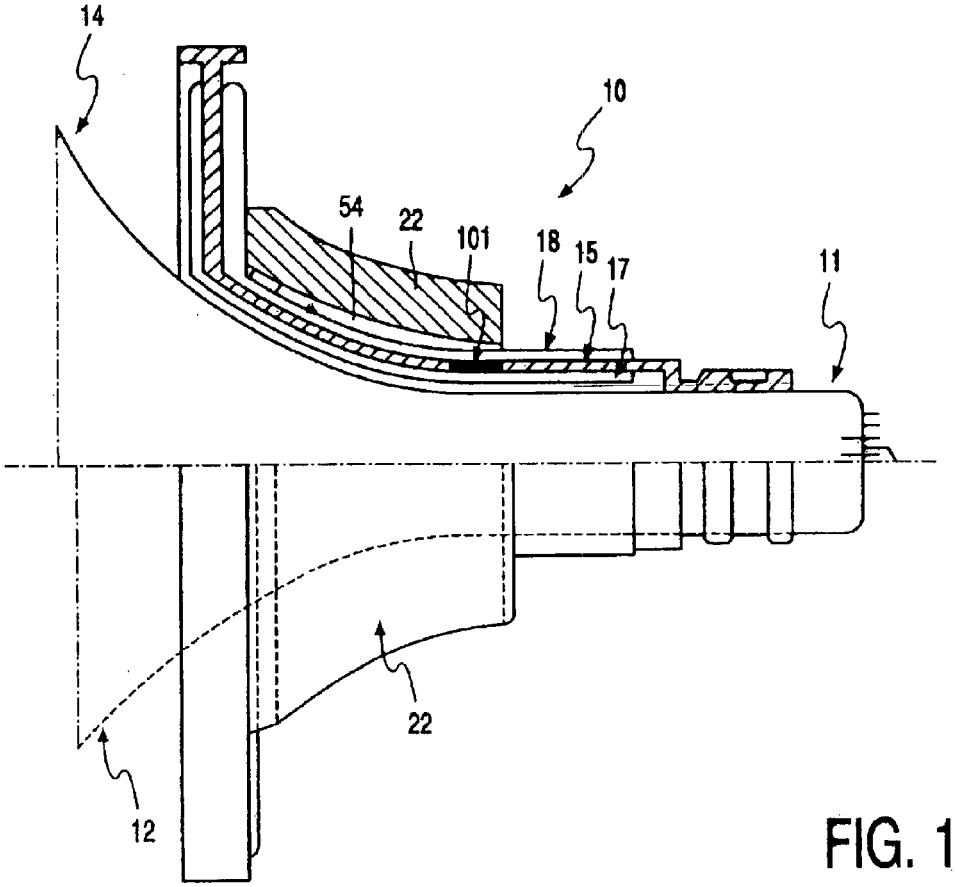

The invention relates to a deflection unit for a cathode ray tube, the deflection unit comprising line deflection coils, frame deflection coils surrounding the line deflection coils, and a yoke ring having a magnetic permeability $\mu_r$ and surrounding the frame deflection coils.

The invention also relates to a cathode ray tube provided with a deflection unit, and to a display apparatus comprising such a cathode ray tube.

A deflection unit comprising frame deflection coils and line deflection coils is known from WO-A 98/26574. A deflection unit of this type is generally constructed in such a way that the two coils are mounted on a hollow support (one on the inner side and one on the outer side) and that a yoke ring surrounds these coils. The purpose of the yoke ring is to short-circuit the magnetic lines of flux outside the coils, which are generated by the frame and line coils during operation. The yoke ring thus reduces unwanted external magnetic stray fields. The yoke ring also reflects the stray fields into a deflection volume, i.e. the volume within the cathode ray tube in which the deflection of electron beams takes place. This also leads to a reduction of the power that is dissipated in the deflection coils. However, a further reduction is desired.

It is an object of the invention to provide a deflection unit for a cathode ray tube wherein the dissipated power for the deflection is reduced. To this end, the deflection unit according to the invention is characterized in that the deflection unit comprises a magnetic material which is present between the line deflection coils and the frame deflection coils and has a magnetic permeability $\mu_1$ which satisfies the relation $\mu_1<\mu_r$.

In the deflection unit according to the invention, the dissipation of the energy is reduced because the magnetic field generated by the line coils is reflected by the magnetic material into the deflection volume. However, a proper selection of the value of $\mu_1$ is important. The inventors have realized that, only if $\mu_1<\mu_r$, the magnetic field generated by the frame coils will be transmitted towards the deflection region, and a reduction of dissipated energy can be obtained. For the frame coils, the function of the magnetic material depends on the value of the magnetic permeability $\mu_1$ of the magnetic material within the deflection unit. If the permeability in this region is comparable to or higher than that of the yoke ring $\mu_r$, the magnetic material acts as a reflector. Hence, the magnetic field generated by the frame coils is reflected away from the deflection volume. This deteriorates the performance of the frame coils.

However, if the condition $\mu_1<\mu_r$ is satisfied, the magnetic material will act as a flux guide, which will lead to an enhancement of the magnetic field of the frame coil inside the deflection volume. Consequently, the current through the flame coils may be reduced, leading to a reduction of ohmic losses in the frame coils as well as a reduction of dissipation in the electronic drive circuits.

It is to be noted that WO-A 00/44028 describes a deflection unit in which void spaces between wire strands within the frame deflection coils and/or void spaces between the yoke ring and the frame coils are filled with magnetic material. No limitation with respect to the relative permeability of the magnetic material is required in this case.

Advantageous embodiments of the invention are defined in the dependent claims.

These and other aspects of the invention will be elucidated with reference to the embodiments described hereinafter.

Figure 2:
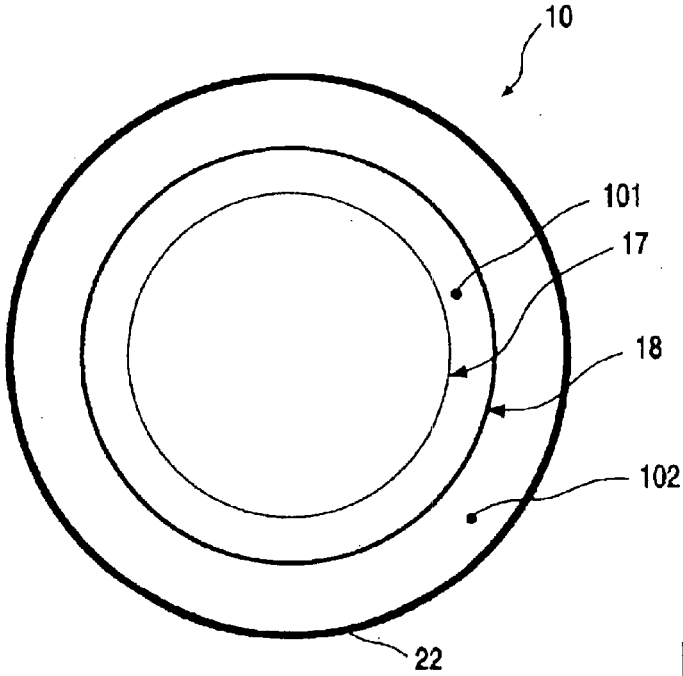
Figure 3:
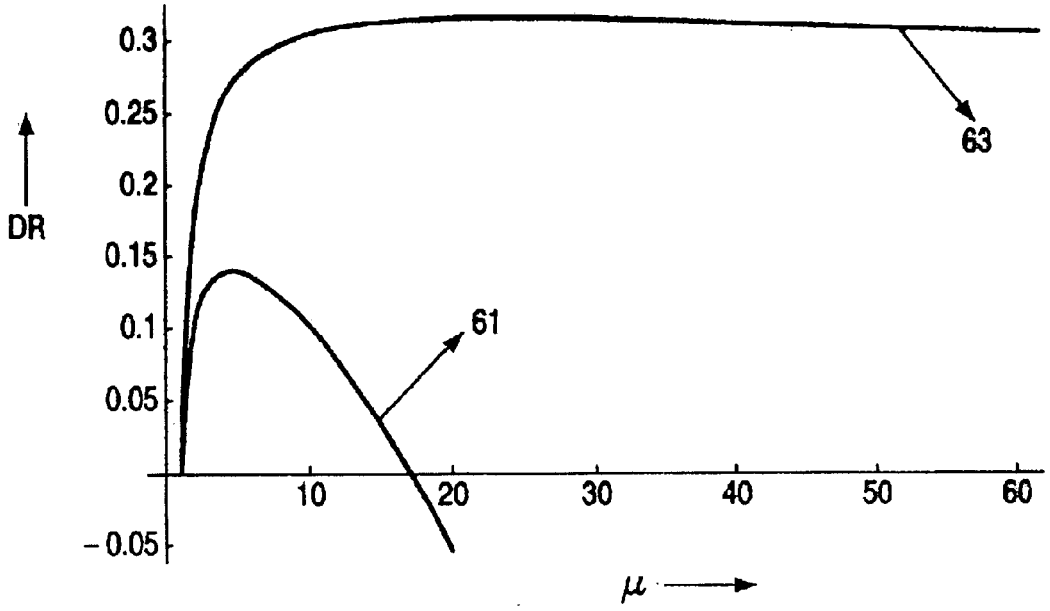
Figure 4:
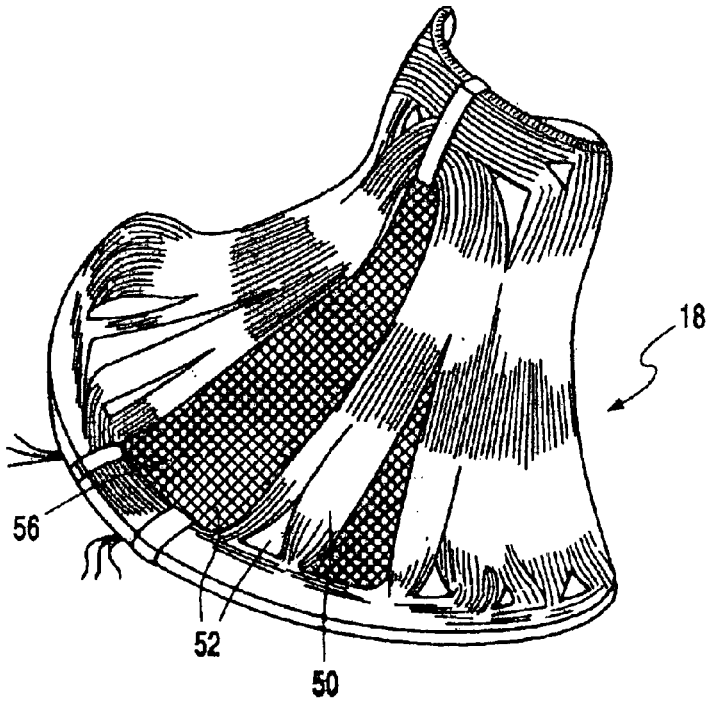
Figure 5:
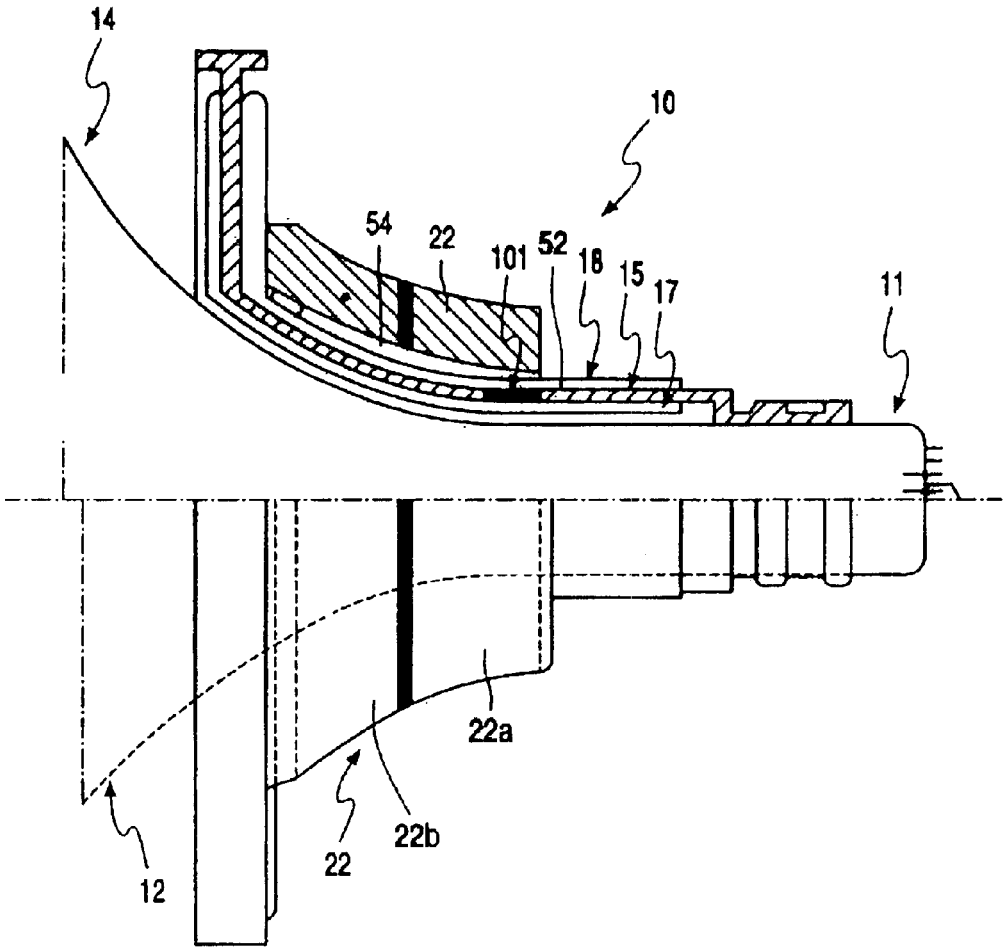
Figure 6:
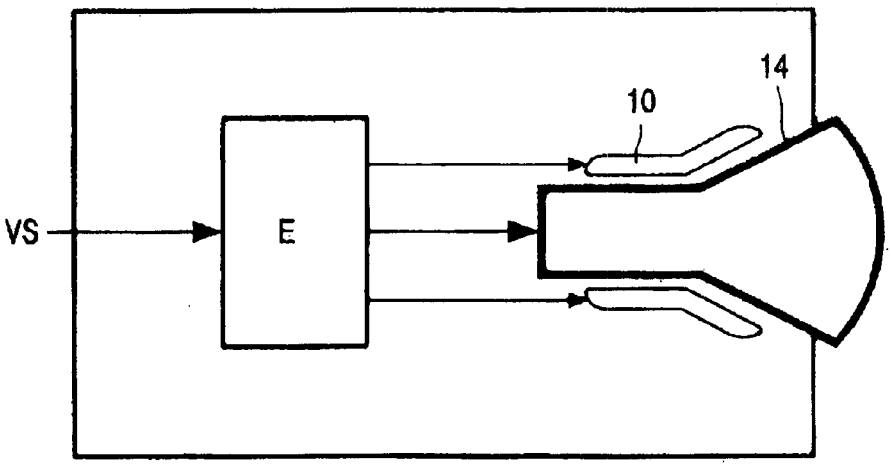
Figure 7:
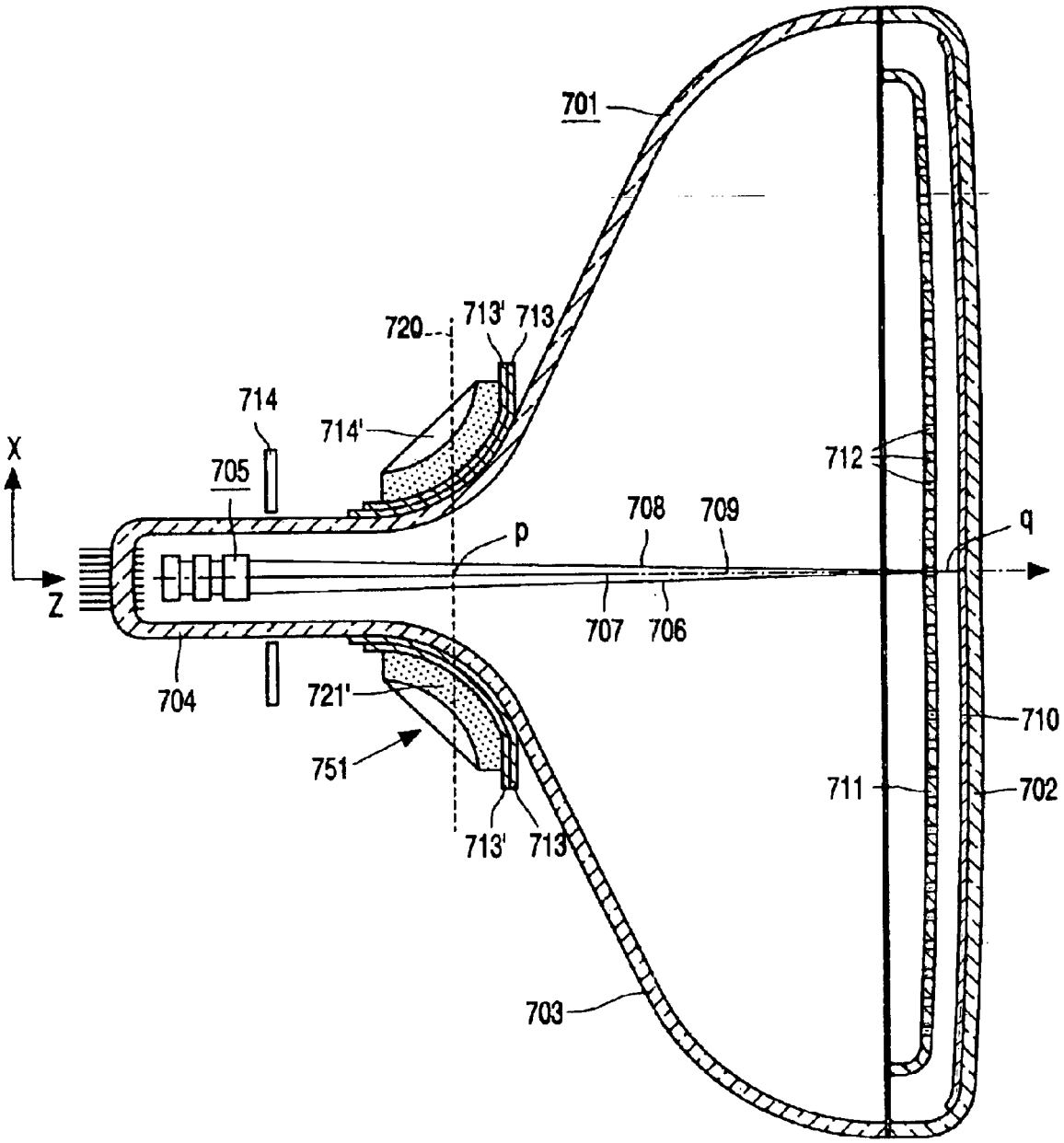
Figure 8A:
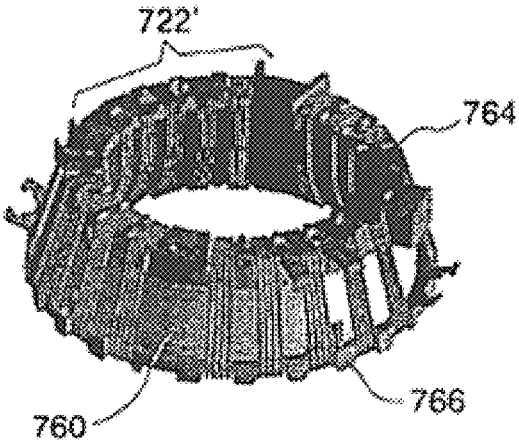
Figure 8B:
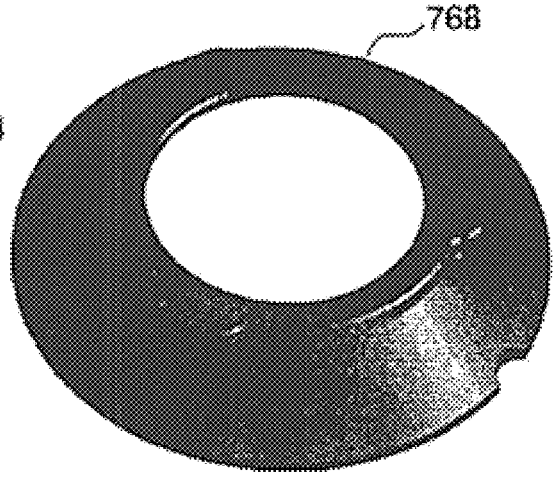
Figure 9:
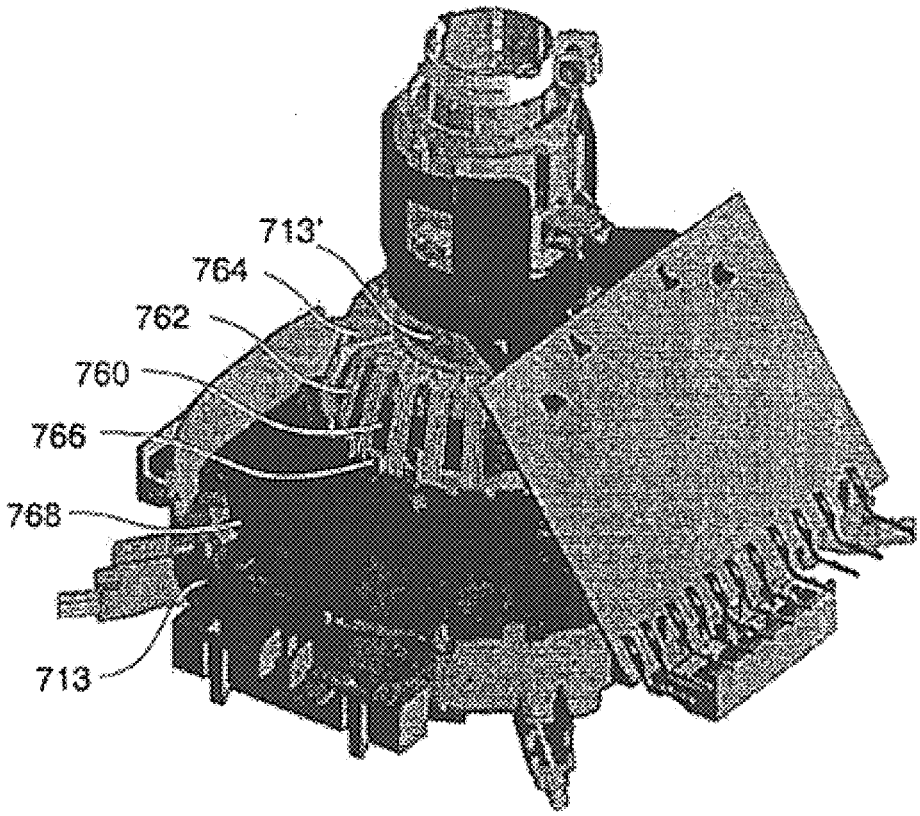
Figure 10A:
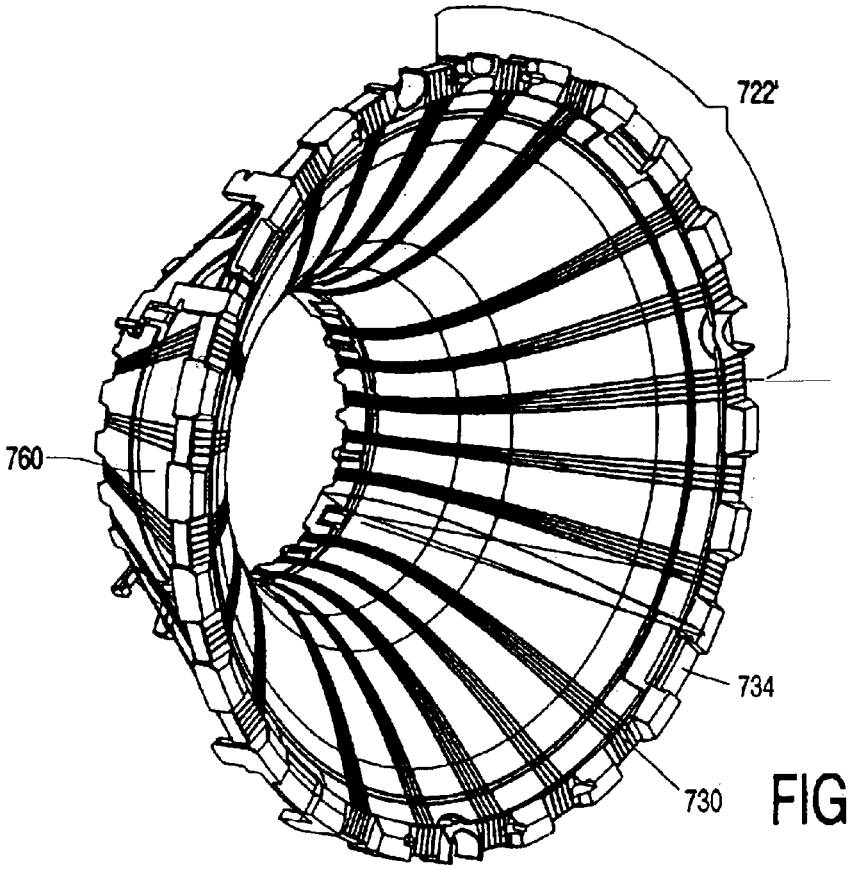
Figure 10B:
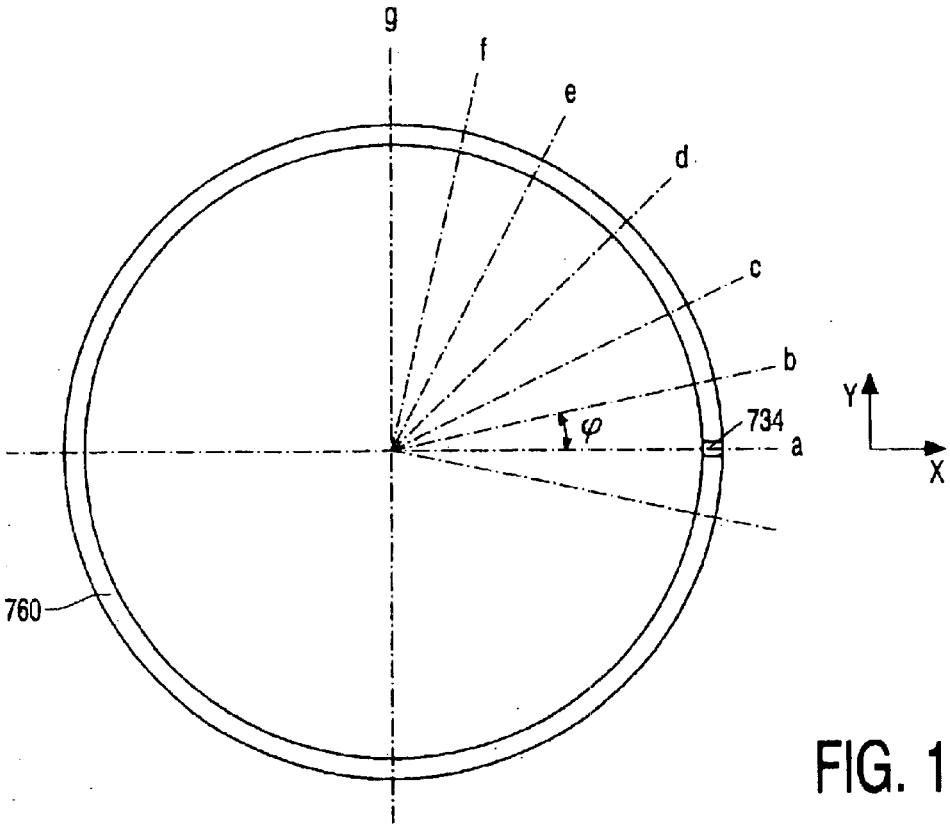
Figure 11:
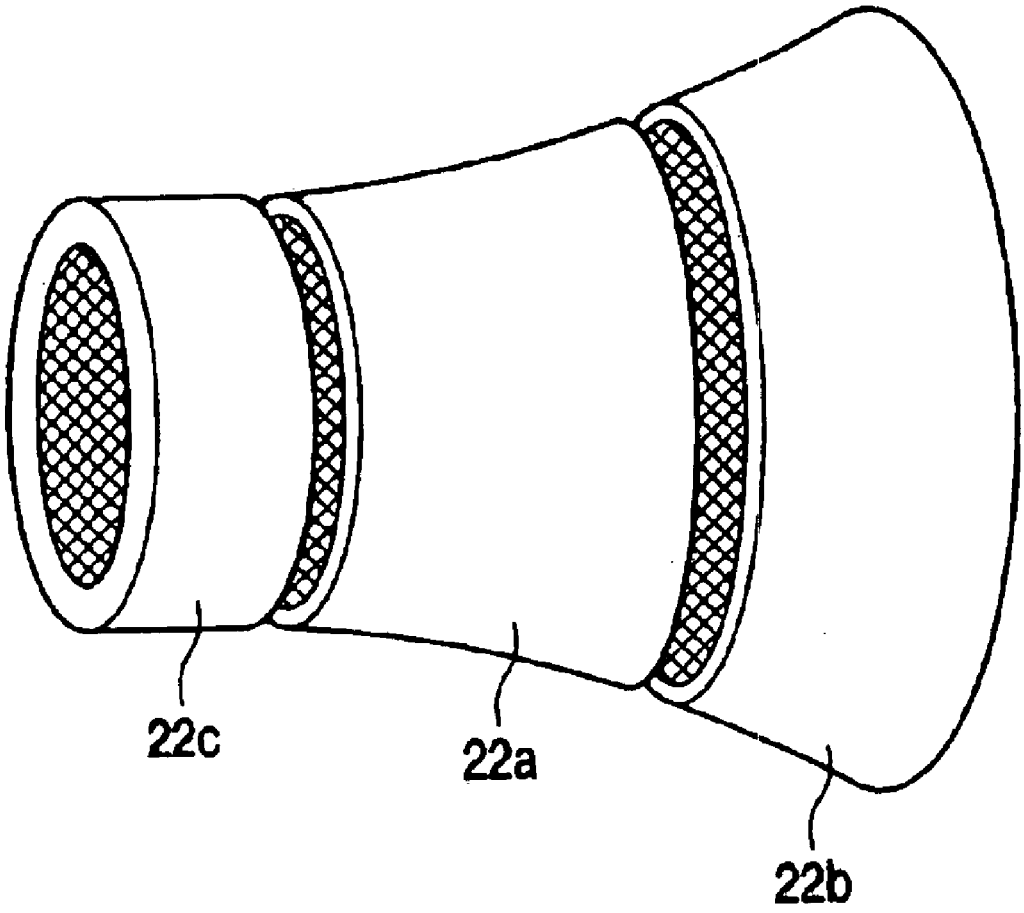

In the drawings,

FIG. 1 shows schematically, partly in a cross-section, partly in a side elevation, a part of a cathode ray tube with an embodiment of the deflection unit according to the invention, FIG. 2 is a schematic cross-section of the deflection unit according to the invention, FIG. 3 is a graph showing the reduction of the energy dissipation in a deflection unit according to the invention, FIG. 4 is a perspective view of a frame deflection coil according to an embodiment of the invention, FIG. 5 shows schematically, partly in a cross-section, partly in a side elevation, a part of a cathode ray tube with a further embodiment of the deflection unit according to the invention, FIG. 6 shows a display apparatus according to the invention, FIG. 7 is a sectional view of a color display device, FIGS. 8A, 8B show a first and a second part of the ring-shaped element according to the invention, FIG. 9 shows a deflection unit according to the invention, FIGS. 10A, 10B show an embodiment of the invention, and FIG. 11 shows a yoke ring according to a further embodiment of the invention.

In general, like reference numerals identify like elements.

Referring to FIG. 1, the deflection unit 10 is shown mounted on the glass envelope 14 of a cathode ray tube at the region between a neck 11 and a cone portion 12 of the envelope 14. The deflection unit 10 comprises a coil support 15 of generally frusto-conical shape which carries a set of two line (horizontal) deflection coils 17 on its inner side, adjacent the envelope surface, and a set of two frame (vertical) deflection coils 18 on its outer side.

The coil support 15, together with the sets of deflection coils 17 and 18 secured thereto, forms a deflection coil assembly. A hollow yoke ring 22, in the shape of a flared annulus generally conforming with the outer contour of the coil assembly is mounted on the outer side of the assembly and fixed thereto. The yoke ring 22 surrounds the coil assembly with its front and rear ends, base, face disposed against an inner portion of the radially extending part of the coil assembly, while its rear, neck, end terminates on an intermediate part of the coil assembly.

The yoke ring 22 is a sintered moulding of soft magnetic material having a relative magnetic permeability $\mu_r$ of typically 500. The yoke ring 22 serves to short-circuit the magnetic lines of flux outside the coils, which are generated by the frame and line coils during operation. In this way, unwanted external magnetic stray fields are reduced and the sensitivity of the line and frame deflection is increased. Although the presence of the yoke ring 22 helps to reduce these magnetic stray fields, a small external magnetic field still remains and a further reduction of this field as well as a reduction of the power dissipated in the coils is desired.

Since there is no perfect fit between the line coils 17, the coil support 15 and the frame coils 18, there are void spaces 101 between these elements. Alternatively, in order to obtain space to be filled by magnetic material, void spaces between the line and frame coils may also be created by selectively removing parts of the coil support 15, or the coil support may be even completely left out. It has been shown both experimentally as well as by finite element simulations that a reduction of the power dissipation may be obtained if the void spaces 101 are filled with a magnetic material having a relative permeability $\mu_1<\mu_r$. This is due to the additional reflection by the magnetic material of fields generated by the line coils and additional guiding by the magnetic material of the magnetic flux of the magnetic fields generated by the frame coils.

FIG. 2 is a schematic cross-section of a deflection unit according to the invention. The yoke ring 22 surrounds the frame coils 18, which surround the line coils 17. The void space 101 between the frame coils and the line coils is indicated, as well as a second void space 102 (indicated as element 54 in FIG. 1) between the frame coils 18 and the yoke ring 22. Calculations as well as experiments were carried out to observe the effect of filling the void spaces 101, 102 with magnetic material. Results of these calculations are shown in FIG. 3, in which the dissipation reduction DR of the deflection unit with respect to the conventional deflection unit is plotted for various values of the permeability $\mu$ of the magnetic filling material.

Curve 61 indicates the results for the case where only void space 101 is filled. A maximal energy reduction of about 15% with respect to conventional deflection units is obtained, dependent on the value of the magnetic permeability of the filling material. For the geometry of this specific deflection unit (for a 32" CRT), using a typical value $\mu_r$=500 for the yoke ring, the maximum is obtained at a permeability value $\mu_1$ of about 5. For other coil sets, the maximum might be obtained at a different permeability value. For all types of deflection units, it holds that the relation $\mu_1<\mu_r$ must be satisfied (as is clearly the case in the present example) because only then a reduction of energy dissipation is obtained.

There are second void spaces 102 between the yoke ring 22 and the frame deflection coils 18. FIG. 4 is a perspective view of a frame deflection coil 18 to be used in the deflection unit shown in FIG. 1. The frame coil 18 comprises wire strands 50 and has third void spaces 52 between the wire strands 50. According to an advantageous embodiment of the invention, the second void spaces 102 and/or third void spaces 52 are filled with a magnetic material 56 having a magnetic permeability $\mu_2$. By filling the second and third void spaces, in addition to void spaces 101, a further reduction of the energy dissipation can be obtained, as is shown in FIG. 3. Curve 63 represents the results for the case where both void spaces 101 and 102 are filled with the same magnetic filling material (hence $\mu_1=\mu_2$) for the same deflection unit. A total dissipation reduction of almost 30% is obtained for magnetic permeability values of the filling material of about or larger than 10 (but smaller than $\mu_r$). Experimental verifications show similar dissipation reductions.

The magnetic material used for filling the second and third void spaces may be the same material as that used for filling the first void spaces. When different magnetic materials are used, it is important that the magnetic permeabilities satisfy the relationship $\mu_2 \geqq \mu_1$. Otherwise, a mirror effect occurs that will reflect the magnetic frame deflection field away from the deflection volume, and consequently the required deflection energy is increased instead of decreased.

Appropriate methods of filling the voids are injection moulding and insertion moulding. In injection moulding, a material is caused to flow out of a nozzle into the voids after application of a pressure to a reservoir containing the material. By subsequent heating or drying, the material is made immobile in the voids. In insertion moulding the object to be filled is surrounded by a dedicated mould, whereafter the material is introduced into the voids under a relatively high pressure. In this way, a good degree of filling the voids is obtained.

It has been found that an additional advantage of filling the DU is that the shape of the magnetic deflection field, and hence the front of screen performance (FOS), becomes much less sensitive to the shape of the inner boundary of the yoke ring. This allows the use of yoke rings with less severe constraints on deviations from roundness, which are easier/cheaper to produce.

Good results were obtained with a plastic deformable magnetic material, comprising a resinous material, which contains a filler of magnetic particles, such as plasto-ferrite. The plastic deformability of the material results in a good accommodation to the local shape of the void spaces. Typically, $\mu_2$ and $\mu_1$ have a value of the order of 10.

A further embodiment of the invention comprises a deflection unit 10 which further comprises a support 15 for carrying both the frame and the line coils 17, 18, which support comprises a material comprising magnetic particles. This embodiment has the advantage that no additional process steps are required for additionally filling the void spaces.

FIG. 5 shows a further advantageous embodiment of the invention, comprising a deflection unit 22 wherein the yoke ring comprises two parts, a first part 22*a* being positioned closer to an electron gun than a second part 22*b*, and wherein only the (first 101 and/or second 102 and/or third 52) void spaces surrounded by the first part of the yoke ring 22*a* are filled with the magnetic material. Note that the second void spaces 102 are indicated as element 54 in FIG. 1. Experimentally, it was demonstrated that a significant decrease of energy dissipation of the coils could already be obtained in this case, because the deflection coils in this area have their largest contribution to the deflection. This will reduce the quantity of required magnetic material and consequently reduces the cost of the deflection unit.

FIG. 6 shows a display apparatus comprising a cathode ray tube assembly, control electronics E coupled to receive a video signal VS to apply a display signal to the cathode ray tube 14 and deflection signals to the deflection unit 10 in dependence on the video signal VS.

A further embodiment of the invention is shown in FIG. 7, wherein the shown display device comprises a color cathode ray tube having an evacuated envelope 701 which includes a display window 702, a cone portion 703 and a neck 704. The neck 704 accommodates an in-line electron gun 705 for generating three electron beams 706, 707 and 708 which extend in one plane, the in-line plane, extending in an X-direction of a rectangular X-Z coordinate system. In the undeflected state, the central electron beam 707 substantially coincides with the tube axis 709, which extends in the Z-direction. A third direction, the Y-direction, extends in a direction perpendicularly to the in-line plane (not shown in the Figure). Conventionally, during operating conditions, the tube is positioned in such a way that the X-Z plane coincides with a horizontal plane and the Y-direction coincides with a vertical direction.

The inner surface of the display window is provided with a display screen 710. The display screen 710 comprises a large number of phosphor elements luminescing in red, green and blue. On their way to the display screen, the electron beams are deflected across the display screen by way of an electromagnetic deflection unit 751 and pass through a color selection electrode 711 which is arranged in front of the display window 702 and comprises a thin plate having apertures 712. The three electron beams 706, 707 and 708 pass through the apertures 712 of the color selection electrode at a small angle relative to each other and hence each electron beam impinges only on phosphor elements of one color. In addition to a coil holder 713, the deflection unit 751 comprises deflection coils 713' for deflecting the electron beams in two mutually perpendicular directions. A ring-shaped element 721', the yoke ring, is positioned around the deflection coils 713'. The display device further includes means for generating voltages, which during operation are fed to components of the electron gun via feedthroughs. The deflection plane 720 is schematically indicated as well as the distance p between the electron beams 706 and 708 in this plane, and the distance q between the color selection electrode and the display screen. The distance q is inversely proportional to the distance p.

The color display device comprises two electron beam convergence-influencing units 714, 714', a first unit 714 being used, in operation, to dynamically bend, i.e. as a function of the deflection in a direction, the outermost electron beams towards each other, and a second unit 714' being used to dynamically bend the outermost electron beams in opposite directions. The means 714 bends the electron beams towards each other, and the means 714' bends the electron beams in opposite directions. As a result, the distance between the electron beams is smaller for deflected electron beams than for undeflected beams. Since the distance p is smaller, the distance q may increase, which leads to an additional design freedom with respect to the curvature of the color selection electrode. The design freedom is used to increase the curvature of the color selection electrode, which has a positive effect on the strength of the color selection electrode, while the sensitivity to doming and vibration decreases.

The two units 714, 714' are positioned at some distance from each other. The first unit 714 is positioned close to the gun and will be referred to as the "gun quadrupole", whereas the second unit 714' is located near or at the deflection unit and will be referred to as the "yoke quadrupole". It is convenient to integrate the means 714' and the deflection unit 751 by winding four coils on the ring-shaped element 721', which coils generate a dynamic electromagnetic quadrupole field.

During operation, the units 714, 714' influence the deflection of the electron beams, which may lead to unwanted artifacts in the image displayed on the window 702. In conventional cathode ray tubes (CRTs), deflection in the vertical (Y-) dimension is a non-linear phenomenon, i.e. the displacement of the electron beams is a non-linear function of the current through the deflection coils. Deflection of the beams requires relatively less current at the extreme sides of the display window. Within the television set in which the tube is applied, an electronic way of correcting the non-linearity takes place, the so-called vertical S-correction. Due to the action of the yoke quadrupole, the deflection of the electron beams is a more linear process, which implies that the S-correction overcorrects the non-linear deflection phenomenon. This is undesired.

Conventional CRTs are also corrected for East-West pincushion raster distortion (East and West are indications of the two vertical sides of the display window). This means that an image consisting of a rectangular raster of horizontal and vertical lines is displayed on the screen as a distorted cushion-like shape, in which the vertical lines close to the border of the display window are bent inwards. It appears that application of the unit 714' increases this image artifact.

The influence of the unit 714' mainly arises at the side of the ring-shaped element 721' that faces the display window 702. It is preferable to split the ring-shaped element 721' into two (axially split) parts, and to wind the quadrupole coils on one of the two parts. Preferably, the quadrupole coil is wound around the core part closest to the electron gun. The measure provides the opportunity to shift the two core parts independently of each other, thus improving raster and convergence performance of the tube. Experimentally, it has been shown that the dissipated deflection energy is reduced if the void spaces are filled with magnetic material according to the invention.

FIGS. 8A and 8B show a further embodiment of the invention. FIG. 8A shows a first part 760 of the ring-shaped element 721', which part is closest to the electron gun 705. The part 760 is provided with four coils 722' for generating the magnetic quadrupole field. Coils are shown that are toroidally wound around the ring-shaped element. However, this mode of winding is not essential to the invention. The quadrupole coils may also be wound around the ring-shaped element in a saddle-like shape. To facilitate the winding process and to keep the individual wire elements of the coil 722' in the right position at the first part 760, the first part is provided on its extremes with rings 764, 766 having grooves in which the coil windings are positioned. FIG. 8B shows a second part 768 of the ring-shaped element 721', which part is closest to the display window 702. When applied to the tube, the two parts 760, 768 may be connected to each other by any conventional connection means, such as glue, tape or the like. Connection of the two parts is not essential for a proper performance.

FIG. 9 shows the two parts 760,768 according to the invention, when positioned around the deflection coils 713' and the coil holder 713. The first part 760 is provided with rings 764,766 and four coils 722' for generating the magnetic quadrupole field.

FIGS. 10A and 10B show an embodiment of the invention wherein the coils 722' around the first part 760 of the ring-shaped element 721 are obtained from electrically conductive wires, which are toroidally wound in a winding direction and in accordance with a winding density distribution N (ϕ) given by $$N(\phi)=N_0 \cos(2\phi);$$

where ϕ is an angle enclosed by the X-direction and a line between an element of the coil and the center, which ranges between 0° and 360°, $N_0$ is the winding density at ϕ equal to 0°, and the sign of N (ϕ) denotes the winding direction.

This embodiment has the advantage that an almost pure quadrupole field can be generated, i.e. the presence of other magnetic multiple fields is largely suppressed.

In practice, only an approximation of the above winding density can be realized due to the finite dimensions of the wire. The embodiment comprises packages 730 of electrically conductive wires, which are toroidally wound around a yoke ring 721' in accordance with the above winding density $$N(\phi)=N_0 \cos(2\phi).$$

In this particular embodiment, windings have been made in grooves 734 of rings 764,766 that are spaced 15 degrees apart. The winding method is as follows:

18 windings in a groove at ϕ=0 degrees (position a),
15 windings in a groove at ϕ=15 degrees (position b),
9 windings at ϕ=30 degrees (position c),
no windings at ϕ=45 degrees (position d),
9 windings with current in an opposing direction in a groove at ϕ=60 degrees (position e),
15 windings at ϕ=75 degrees (position f),
18 windings at ϕ=90 degrees (position g), etc. Practice has proved that this approximation of the ideal winding density N (ϕ) gives good results.

A further embodiment of the invention is shown in FIG. 11, wherein a yoke ring is shown which further comprises a third part 22*c*, positioned closer to the neck portion 11 of the cathode ray tube than the first part 22*a* and where only the void spaces surrounded by the first part of the yoke ring 22*a* are filled with the magnetic material. This has the advantage that the deflection energy is simultaneously reduced by filling the void spaces surrounded by the first part 22*a*, whereas, by not filling the void spaces surrounded by the second part 22*b* and the third part 22*c*, so-called asymmetry errors can be corrected by shifting and/or tilting these parts of the yoke ring.

A disadvantage of filling the deflection unit completely is that asymmetry errors in the generated magnetic field can no longer be corrected by shifting and/or tilting the yoke ring. This can be partly solved by using a yoke ring split into two parts, of which only the neck side is filled and the screen ring is used for matching, which is the process by which asymmetry errors are reduced by shifting and/or tilting the yoke ring. This may have the drawback that the so-called pullback, i.e. the minimal distance between the inner glass contour and the outermost electron beam becomes too small. This can be corrected by optimization of the coils, but is at the expense of an increase of energy dissipation. Consequently, a part of the advantage of the dissipation reduction is lost. This can be understood as follows. Filling the two-part yoke ring only at the neck side enhances the magnetic field at that position more than at the screen side. This means that the deflection point will shift towards the neck part of the deflection unit, because the deflection starts at an earlier instant. In order to shift the deflection point back towards the original position, one has to generate an extra magnetic field at the screen side, which requires additional magnetic energy. A straightforward method of achieving a maximal dissipation gain with a minimal pull-back reduction is to fill the whole length of the yoke ring. However, in that case asymmetry errors must be corrected electronically by means of an additional correction coil, which is undesired.

It is therefore proposed to split the yoke ring into three parts 22*a*, 22*b*, 22*c* as is shown in FIG. 11. Only the first (middle) part 22*a* is filled with the magnetic material. The other two ring parts 22*b*, 22*c* can be used for matching, both at the neck side (third part 22*c*) and the screen side (second part 22*b*). By not filling the third part 22*c*, the field is not enhanced in this region. This would lead to a smaller dissipation gain. However, this is compensated by filling the middle ring 22*a* also beyond the deflection point (i.e. by using a smaller screen ring than in the case of a single split yoke ring). Furthermore, the neckward shift of the deflection point is reduced by not filling the neck ring.

In summary, the invention relates to a deflection unit 10 for cathode ray tubes in which energy for deflection is reduced. This is done by providing magnetic material 56 between frame coils 18 and line coils 17 of the deflection unit. In an advantageous embodiment of the invention, first void spaces 101 as well as second void spaces 102, 54 between the frame coils and a yoke ring and/or third void spaces 52 between wire strands of the frame coils are filled. A deflection energy reduction of up to 30% can be obtained.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Use of the article "a" or "an" preceding an element does not exclude the presence of a plurality of such elements.

What is claimed is:

1. A deflection unit for a cathode ray tube, the deflection unit comprising:

line deflection coils, frame deflection coils surrounding the line deflection coils, and a yoke ring having a magnetic permeability $\mu_r$ and surrounding the frame deflection coil, wherein the deflection unit comprises a magnetic material which is present between the line deflection coils and the frame deflection coils and has a magnetic permeability $\mu_1$ which satisfies the relation $\mu_1<\mu_r$.

2. A deflection unit as claimed in claim 1, wherein void spaces are present between the line deflection coils and the frame deflection coils, and the void spaces are filled with the magnetic material.

3. A deflection unit as claimed in claim 1, wherein the deflection unit further comprises a support for carrying both the frame and the line coils, said support comprising the magnetic material.

4. A cathode ray tube assembly comprising a deflection unit as claimed in claim 1.

5. A display apparatus, comprising:

a cathode ray tube assembly as claimed in claim 4, control electronics coupled to receive a video signal to apply a display signal to the cathode ray tube and deflection signals to the deflection unit in dependence on the video signal.

6. A deflection unit comprising:

line deflection coils, frame deflection coils surrounding the line deflection coils, and a yoke ring having a magnetic permeability $\mu_r$ and surrounding the frame deflection coils, wherein the deflection unit comprises a magnetic material which is present between the line deflection coils and the frame deflection coils and has a magnetic permeability $\mu_1$ which satisfies the relation $\mu_1<\mu_r$, void spaces are present between the line deflection coils and the frame deflection coils, the void spaces are filled with the magnetic material, second void spaces are present between the frame deflection coils and the yoke ring, and third void spaces are present between wire strands of the frame deflection coils, and at least on the second and third void spaces are filled with a magnetic material having a magnetic permeability $\mu_2$ which satisfies the relationship $\mu_2 \geqq \mu_1$.

7. A deflection unit as claimed in claim 6, wherein the yoke ring comprises at least two parts, a first part being positioned closer to a neck portion of the cathode ray tube than a second part, and wherein only the void spaces surrounded by the first part of the yoke ring are filled with the magnetic material.

8. A deflection unit as claimed in claim 7, wherein the first and/or the second part have four coils for generating a magnetic quadrupole field.

9. A deflection unit as claimed in claim 8, wherein said coils comprise electrically conductive wires which are toroidally wound in a winding direction and in accordance with a winding density distribution N (ϕ) given by $N(\phi)=N_0 \cos(2\phi)$;

where

ϕ is an angle enclosed by an X-direction and a line between an element of the coil and the center, which ranges between 0° and 360°, $N_0$ is the winding density at ϕ equal to 0°, and the sign of N (ϕ) denotes the winding direction.

10. A deflection unit as claimed in claim 7, wherein the yoke ring further comprises a third part which is positioned closer to the neck portion of the cathode ray tube than the first part.

11. A deflection unit for a cathode ray tube, comprising:

line deflection coils, frame deflection coils surrounding the line deflection coils, and a yoke ring surrounding the frame deflection coils, comprising at least two parts, a first part being positioned closer to a neck portion of the cathode ray tube than a second part, wherein void spaces are present between the line deflection coils and the frame deflection coils, and the void spaces surrounded only by the first part of the yoke ring are filled with magnetic material.

12. The deflection unit of claim 11, wherein the yoke ring has a magnetic permeability $\mu_r$, the magnetic material has a magnetic permeability $\mu_1$, and $\mu_1<\mu_r$.

13. The deflection unit of claim 11, wherein the first part includes four coils for generating a magnetic quadrupole field.

14. The deflection unit of claim 13, wherein the four coils comprise electrically conductive wires which are toroidally wound in a winding direction and in accordance with a winding density distribution N (ϕ) given by $N(\phi)=N_0 \cos(2\phi)$; where ϕ is an angle enclosed by an X-direction and a line between an element of the coil and the center, which ranges between 0° and 360°, $N_0$ is the winding density at ϕ equal to 0°, and the sign of N (ϕ) denotes the winding direction.

15. The deflection unit of claim 11, wherein the yoke ring further comprises a third part that is positioned closer to the neck portion of the cathode ray tube than the first part.

16. A cathode ray tube assembly comprising a deflection unit as claimed in claim 11.

17. A display apparatus, comprising:

a cathode ray tube assembly as claimed in claim 16, control electronics coupled to receive a video signal to apply a display signal to the cathode ray tube and deflection signals to the deflection unit in dependence on the video signal.

18. A deflection unit comprising:

line deflection coils, frame deflection coils surrounding the line deflection coils, a yoke ring surrounding the frame deflection coils, first magnetic material between the line deflection coils and the frame deflection coils, and second magnetic material between the frame deflection coils and the yoke ring.

19. The deflection unit of claim 18, wherein a magnetic permeability of the yoke ring is greater than a magnetic permeability of the first magnetic material and the second magnetic material.

20. The deflection unit of claim 19, wherein the magnetic permeability of the second magnetic material is greater than the magnetic permeability of the first magnetic material.

* * * * *